United States Patent [19]

Funk

[11] 4,391,468

[45] Jul. 5, 1983

[54] METHOD AND APPARATUS FOR RECOVERING MINERAL NODULES FROM THE OCEAN FLOOR

[75] Inventor: Erwin D. Funk, Glen Falls, N.Y.

[73] Assignee: Kamyr, Inc., Glen Falls, N.Y.

[21] Appl. No.: 72,778

[22] Filed: Sep. 5, 1979

Related U.S. Application Data

[63] Continuation-in-part of Ser. No. 894,433, Apr. 7, 1978, abandoned.

[51] Int. Cl.[3] ..... E02F 5/00

[52] U.S. Cl. ..... 299/8; 37/DIG. 8; 37/58

[58] Field of Search ..... 299/8, 9; 37/DIG. 8, 37/58

[56] References Cited

U.S. PATENT DOCUMENTS

| | | | |
|---|---|---|---|
| 3,480,326 | 11/1969 | Sheary et al. | 299/8 |
| 3,522,670 | 8/1970 | Flipse et al. | 37/58 |
| 3,672,725 | 6/1972 | Johnson | 299/8 |
| 3,748,248 | 7/1973 | Wanzenberg | 299/8 X |
| 3,753,303 | 8/1973 | Holzenberger | 37/DIG. 8 |
| 3,765,727 | 10/1973 | Santangelo | 37/DIG. 8 X |
| 3,955,294 | 5/1976 | Morgenstein | 299/9 X |
| 3,971,593 | 7/1976 | Porte et al. | 299/8 |
| 4,053,181 | 10/1977 | Saito | 37/DIG. 8 |
| 4,141,159 | 2/1979 | Morris et al. | 37/DIG.8 X |

OTHER PUBLICATIONS

"Pump Applications Engineering", H. B. Hicks and T. W. Edwards, 1971, pp. 227–228.

"Reaching for Deep-Ocean Metals," Machine Design, Jun. 28, 1973, pp. 20–25.

"Who Owns the Ocean?", Compressed Air Magazine, Jun. 1977, pp. 10–13.

"The Great Race to Mine The Ocean Floor" The Compass Marine Office of America Corporation, Spring-/Summer 1977, pp. 19–25.

Perry Chemical Engineering Handbook, Fifth Edition, pp. 5–65, FIG. 5–82.

*Primary Examiner*—Ernest R. Purser

*Attorney, Agent, or Firm*—Cushman, Darby & Cushman

[57] ABSTRACT

A method of recovering mineral nodules deposited on the ocean floor which comprises the steps of pumping a continuous flow of ocean water along a first confined path through an exchange position within the vicinity of the ocean floor where the mineral nodules to be recovered are deposited from an ocean water inlet position out of the aforesaid ocean vicinity and then upwardly to a discharge position on a surface vessel, confining ocean water within a second path within the aforesaid ocean vicinity, continuously flowing ocean water in the second path by pumping the same at a pumping position spaced down-stream from an exchange position therein, continuously moving from the ocean floor to a separating position within the aforesaid ocean vicinity a mixture containing deposited mineral nodules and smaller particles forming a part of the ocean floor on which the mineral nodules were deposited, continuously separating the mixture at the separating position so as to obtain a supply of separated mineral nodules within ocean water, continuously feeding the supply of separated mineral nodules to the second path at a feeding position upstream from the exchange position therein, and continuously exchanging between the exchange positions within the first and second paths successive incremental volumes of ocean water and mineral nodules from the second path to the first path with comparable successive incremental volumes of ocean water from the first path to the second path.

19 Claims, 5 Drawing Figures

METHOD AND APPARATUS FOR RECOVERING MINERAL NODULES FROM THE OCEAN FLOOR

This application is a continuation-in-part of my earlier filed application Ser. No. 894,433, filed Apr. 7, 1978 and now abandoned.

This invention relates to a method for mining of ferro manganese nodules from the ocean floor at depths to 6000 meters.

Metals such as manganese, nickel, copper and cobalt are contained in precipitated nodules lying on the ocean bottom in many parts of the world. Examples of printed publication articles describing these nodules are as follows: "Reaching for Deep-Ocean Metals", MACHINE DESIGN, June 28, 1973, pp 20–25; "Who Owns the Oceans?", COMPRESSED AIR MAGAZINE, June 1977, pp 10–13; and "The Great Race to Mine the Ocean Floor", THE COMPASS, Marine Office of America Corporation (MOAC), Spring/Summer 1977, pp 19–25.

The types of metals in these nodules are of particular interest to developed nations as a source of raw materials. Nickel and copper offer the greatest potential to these developed nations. As indicated in the above articles, full scale production of nickel from the nodules could produce low cost nickel that would allow industry to use stainless steel in place of carbon steels for automobiles and structures with a great gain in overall metal utilization efficiency due to the corrosion resistance of these materials. Additionally, manganese nodules exhibit large surface areas in the range of 100 to 300 square meters per gram. Reports of highly reactive surfaces show nodules to be a potential source of general catalytic agents.

A general problem presenting an obstacle to commercial production of nodules has been the unavailability of an environmentally safe means of mining the nodules. Three leading methods of mining the nodules are the air lift pump, hydraulic pump and continuous line bucket systems. Exemplary U.S. Pat. Nos. disclosing examples of these methods are as follows: 3,522,670; 3,748,248; 3,753,303; 3,765,727; and 3,955,294. For purposes of background, the disclosures contained in the above-identified articles and patents are hereby incorporated by reference into the present specification.

The air lift pump and hydraulic pump both pump bottom water, silt and fauna to the ocean surface. The continuous line buckets raise silt and fauna in a water column as the buckets rise. Tests performed during July and August of 1970 on a prototype deep mining air lift pumping system on the Black Plateau showed that dye, released with the surface discharged deep water, mixed slowly with surface water. Additionally, the raised water exhibited high nutrient levels which showed high levels of plankton growth. Continuous line bucket systems would not present this phenomena; however, effects could be similar at lower depths.

The discharge of nutrient rich, sediment laden bottom water, into overlying water masses could potentially upset the life cycle chains of the oceans' species. The introduction of trace metals and particularly organic material and their distribution throughout the ocean presents a potential pollution problem.

It is an object of the present invention to provide a method for recovering mineral nodules deposited on the ocean floor to the ocean surface without raising ocean bottom nutrients, silt and fauna.

In its broadest sense the present invention contemplates a method by which this objective is obtained which comprises the steps of pumping a continuous flow of ocean water along a first confined path through an exchange position within the vicinity of the ocean floor where the mineral nodules to be recovered are deposited from an ocean water inlet position out of the aforesaid ocean vicinity and then upwardly to a discharge position on a surface vessel. Ocean water is continuously flowed along a second path within the aforesaid ocean vicinity by pumping ocean water at a pumping position spaced downstream from an exchange position in the second path. A mixture containing the deposited mineral nodules and smaller particles from a part of the ocean floor on which the mineral nodules were deposited is continuously moved from the ocean floor to a separating position within the aforesaid ocean vicinity where the mixture is separated so as to provide a supply of separated mineral nodules within ocean water. This supply of separated mineral nodules is then continuously fed to the aforesaid second path at a feeding position therein upstream from the exchange position in the second path. A known hydraulic transfer device is then used at the aforesaid ocean vicinity to continuously exchange between the exchange positions within the first and second paths successive incremental volumes of ocean water and mineral nodules from the second path to the first path with comparable successive incremental volumes of ocean water from the first path to the second path. By utilizing these procedures ocean water without bottom nutrients is utilized as the conveying medium from the ocean floor to the ocean surface vessel. In a preferred embodiment, a dual line between the ocean floor and surface vessel is utilized in which case the pumping work required to effect such conveyance is provided and maintained by a pump on the surface vessel drawing nutrient free supply water adjacent the surface. In another embodiment, a single line between the ocean floor and surface vessel is utilized, in which case the conveying pump is positioned near the ocean bottom but draws nutrient free supply water from a position outside the aforesaid ocean vicinity. It is of significance that the conveyance of the nodules in the ocean water takes place after a separation of the nodules from the smaller particles containing the bottom nutrients which formed a part of the ocean floor on which the mineral nodules were deposited and which were initially removed from the ocean floor with the nodules.

In accordance with the principles of the present invention, the separation of the nodules from the smaller particles with which they are initially contained at the ocean bottom can be achieved either by mechanically removing nodules and associated small particles from the ocean floor or by hydraulically removing the same. To a considerable extent the choice as to which separation procedure to employ will be determined by the nature and condition of the nodule deposits. For example, mechanical removal may be necessitated by certain nodule deposit conditions where hydraulic removal would be impractical.

Mechanical removal and separation, in accordance with the principles of the present invention, preferably involves screening the mixture in the ocean environment itself immediately following mechanical removal by directing the ocean water flow outlet of the second path across a small size screen over which the mixture is mechanically moved. The suction inlet end of the second path is communicated with the underside of a second larger size screen over which the nodules are moved and through which the nodules can pass. In this way, the separated nodules below a predetermined size are continuously fed into the second flow path where they move to the exchange position and are transferred to the first path for movement with the ocean water therein up to the surface.

Where hydraulic nodule removal is feasible, as in most conditions, separation is achieved within a liquid and particle containing chamber maintained in the vicinity of the ocean floor where the nodules to be recovered are deposited. The chamber is provided with an inlet for a flow of ocean water containing the mineral nodules below a predetermined size and other smaller particles therethrough into the chamber. Ocean water and entrained smaller particles are continuously pumped from a first position within the chamber back into the ocean at a rate sufficient to maintain a flow of ocean water, mineral nodules below the aforesaid predetermined size and smaller particles through the inlet and into the chamber at a second position spaced from the first position. The mineral nodules entering the chamber in the second position are allowed to move downwardly under the action of gravity within the chamber into a third position at the bottom of the chamber spaced from the first and second positions. As the nodules settle into the third position at the bottom of the chamber they are continuously fed into the second flow path where they move to the exchange position and are transferred to the first path for movement with the ocean water therein up to the surface.

In accordance with the principles of the present invention, further anti-pollutive and costsaving effects may be achieved by separating on the surface vessel the ocean water utilized to accomplish the conveyance of the separated nodules from the vicinity of the ocean floor to the ocean surface. The movement of nodules through a conduit by a fluid medium necessarily subjects the nodules to a surface abrasion which tends to diminish the nodule size and create small particles of nodule material. The recovery of these small particles can also be of economic significance and hence the separation at the surface vessel, in accordance with the principles of the present invention, contemplates not only a separation of the nodules from the entraining ocean water, but a clarification of the entraining ocean water so as to recover therefrom the mineral particles smaller than the nodules. The clarified ocean water recovered is then utilized as a source of nodule conveying medium in the first flow path rather than being totally dumped into the ocean at the surface level.

The present invention also contemplates apparatus for carrying out the procedures of the present invention. An important aspect of the apparatus invention is that the apparatus constitutes a new combination of components each of which has proven working characteristics in other different combinations.

These and other objects of the present invention will become more apparent during the course of the following detailed description and appended claims.

The invention may best be understood with reference to the accompanying drawings, wherein an illustrative embodiment is shown.

IN THE DRAWINGS

Figure 1:
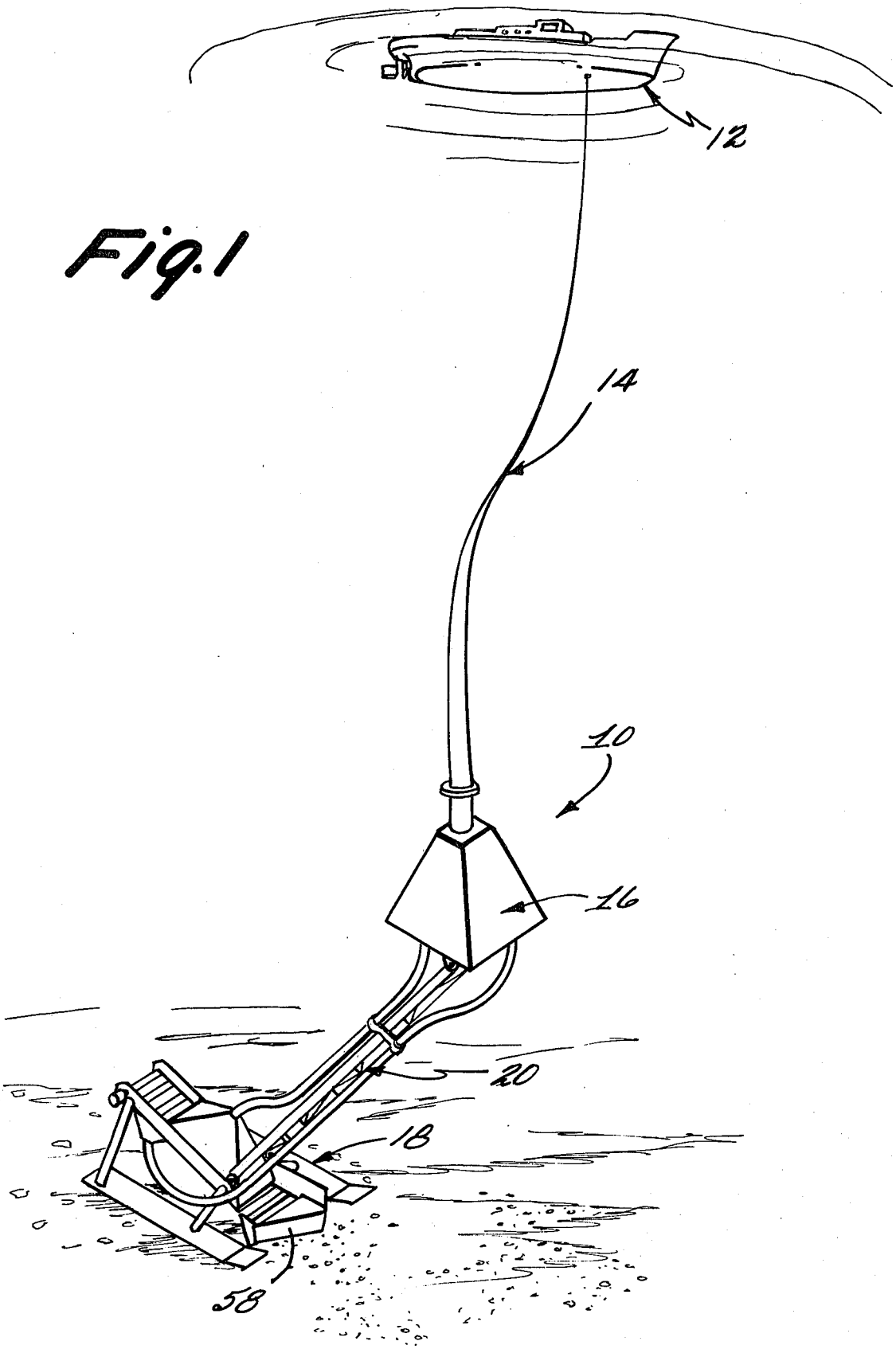
FIG. 1 is a perspective view of one embodiment of an apparatus constructed in accordance with the principles of the present invention for carrying out the method of the present invention, the apparatus being shown in its operative position.
Figure 2:
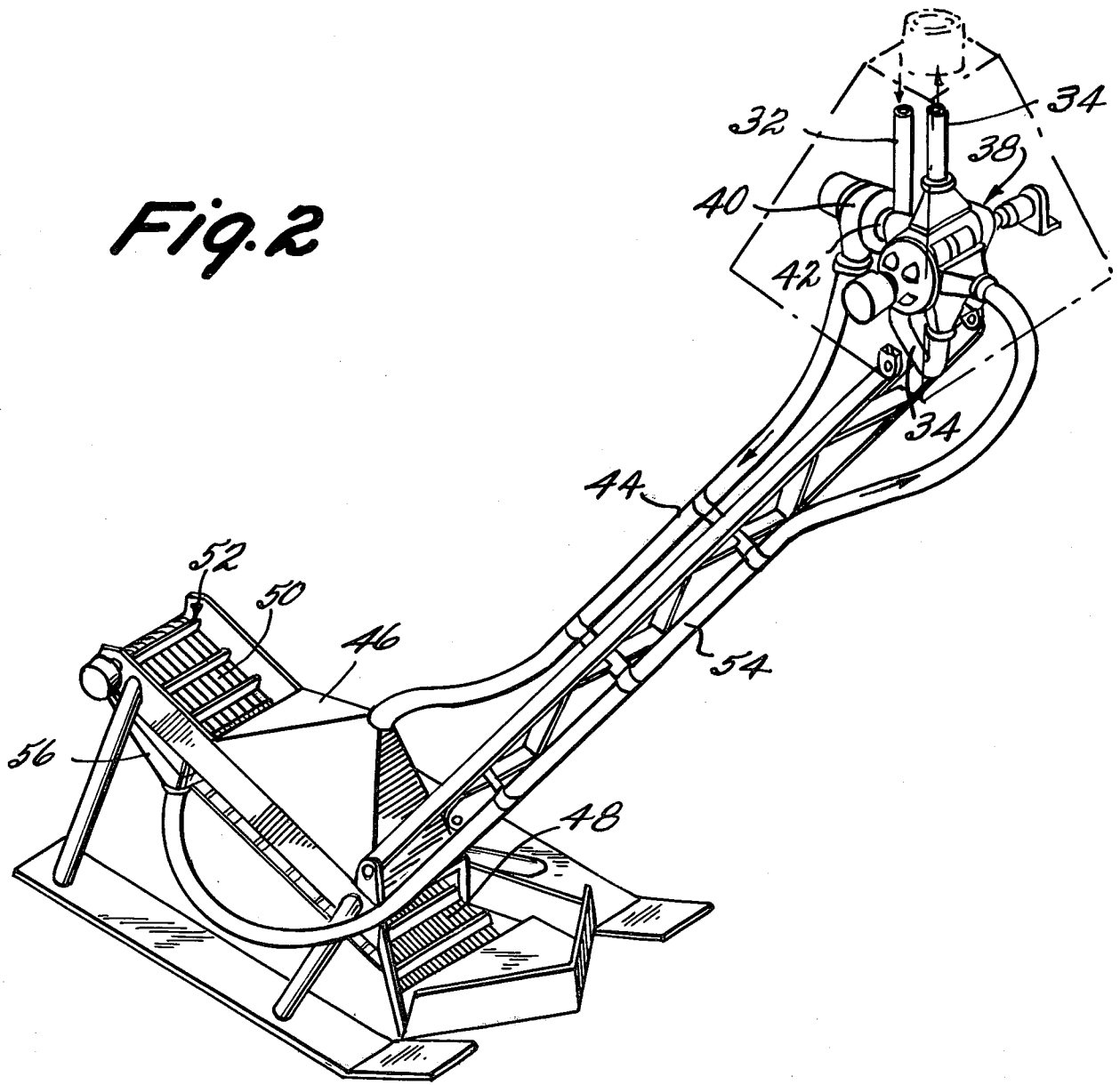
FIG. 2 is an enlarged fragmentary perspective view of the components of the apparatus maintained in the vicinity of the ocean floor where the nodules to be recovered are deposited.

Referring now more particularly to FIGS. 1 and 2 of the drawings, there is shown therein one form of an apparatus, generally indicated at 10, for recovering mineral nodules deposited on the ocean floor. The apparatus 10 has a general similarity to the apparatus disclosed in the aforesaid U.S. Pat. No. 3,522,670, in that there is provided a surface vessel, generally indicated at 12 and an elongated fluid conveyor, generally indicated at 14, extending from the surface vessel to a position adjacent the ocean floor. The fluid conveyor 14 has a dead weight assembly, generally indicated at 16, on the lower end thereof at a position adjacent the ocean bottom. The apparatus also includes a nodule harvesting assembly, generally indicated at 18, which is articulately interconnected with the dead weight assembly 16 by a truss assembly 20. The apparatus of the present invention is generally similar in that it is deployed and advanced along the ocean bottom in the manner disclosed in U.S. Pat. No. 3,522,670.

The present invention is more particularly concerned with the manner in which the mixture of nodules and surrounding particulate material of the ocean bottom is handled within the apparatus and the combination of apparatus components for accomplishing the aforesaid handling procedures rather than the structure and procedure by which the components are deployed within the ocean or the manner in which the components are moved into an operative relation along the ocean floor once deployed. Consequently, the disclosure of U.S. Pat. No. 3,522,670 is hereby incorporated by reference into the present specification for purposes of disclosing a preferred system for deployment and ocean bottom movement of the apparatus. It will be understood, however, that the arrangement of the aforesaid patent is referred to merely as illustrative, and that any known arrangement for deployment and ocean bottom movement may be utilized. With the above in mind, it will be understood that the truss assembly 20 of the present invention is constructed in the manner suggested in the aforesaid patent and both the dead weight assembly 16 and nodule harvesting assembly 18 are provided with suitable frames interconnected with the truss assembly 20 in the manner taught by the aforesaid patent. The fluid conveying means 14 of the present invention is comparable to the conveying means of the aforesaid patent only to the general extent noted above. The fluid conveying means of the present invention differs from that of the aforesaid patent basically in that the pump for effecting a movement of the ocean water conveying medium is located on the surface vessel 12. This pump is shown schematically in FIG. 4 designated by the numeral 22. The pump 22 has its inlet connected with an inlet conduit 24 which, in turn, is connected in parallel with a pair of supply conduits 26 and 28. Supply conduit 28 draws ocean water from a tank 30 carried by the surface vessel 12 while the open inlet end of the supply conduit 28 is maintained within the ocean at a position adjacent the surface and near the surface vessel 12.

The outlet of the pump 22 is connected with one end of a conduit assembly or section 32 which extends downwardly from the surface vessel 12 to an exchange position on the dead weight assembly 16. A similar conduit section 34 extends from the exchange position upwardly to the surface vessel 12 to a discharge position thereon indicated at 36. Conduit sections 32 and 34 may be of any suitaable construction and define a first condined flow path for ocean water extending from the pumping position of the pump 22 on the surface vessel downwardly through the exchange position at the dead weight assembly 16 and then upwardly to the surface vessel to the discharge position 36. At the exchange position within the first flow path a transfer device, generally indicated at 38, is provided. This device is constructed in accordance with the teachings contained in commonly-assigned U.S. Pat. No. 3,982,785, the disclosure of which is hereby incorporated by reference into the present specification.

The transfer device 38 also provides an exchange position for a second confined flow path extending between the harvesting device 18 and the dead weight assembly 16. As shown, the second path includes within it a hydraulic pump 40 which is carried by the dead weight assembly 16. The inlet side of the pump 40 is connected by a conduit 42 to the exchange position of the second path provided by the transfer device 38. A conduit section 44 extends from the outlet of the pump 40 to a hood 46 extending over a first screen 48 of a size to allow the passage of particles therethrough having a nominal diameter of ¼". The screen 48 is mounted on the frame of the harvester assembly 18 in a position to receive the nodules and contiguous small particles of the ocean bottom as they are moved therefrom by the movement of the harvesting assembly 18. Forming a continuation of the first screen 48 is a second screen 50. The second screen 50 is of a size range to permit passage of nodules therethrough of a size suitable for conveyance to the surface vessel, while preventing passage therethrough of oversize nodules, as for example, 8" nominal diameter.

The mixture of nodules and solid particles from the ocean bottom moved therefrom by the movement of the harvester assembly 18 is received on the first screen 48 and moved therealong by an endless scraper conveyor assembly, generally indicated at 52. As the nodules and surrounding particulate material are moved past the first screen, the flow of ocean water issuing from the outlet hood 46 of the conveyor 44 of the second flow path will serve to move the smaller particulate matter through the screen while the larger nodules are moved thereover by the scraper flights 52. Connected to the transfer device 38 in the exchange position of the second flow path thereof is a conduit section 54, the inlet end of which is communicated, as by an inlet hood 56, below the second screen 50. In this way ocean water is induced to flow from a position above the second screen through the same into the inlet hood 56 and through conduit 54 by pump 40.

It will be understood that transfer device 38 includes a rotor having a multiplicity of pockets extending therethrough. During the rotational movement of the rotor by a hydraulic motor or the like, a continuous generally constant flow of liquid through the respective exchange positions of the first and second flow paths is permitted while at the same time there is accomplished continuous exchange between both flow path exchange positions. This exchange includes incremental volumes of nodules and entraining ocean water from the second flow path contained within successive pockets into the first path. The nodules are blocked from flowing through the exchange position of the second path by a screen in the connection of the transfer device with conduit 42. The continuous exchange also includes comparable incremental volumes of ocean water from the first flow path contained within successive pockets to the second flow path.

It will be understood that any appropriate power source may be utilized to move the scraper conveyor 52, the rotor of the transfer device 38 and the pump 40, all of which are positioned within the ocean in the vicinity of the floor where the nodules to be recovered are deposited. An advantage of the hydraulic conveying system of the present invention is that energy in the form of the liquid flowing in the first flow path may be utilized as the energy source for driving the conveyor assembly 52, rotor of the transfer device 38 and pump 40 simply by providing hydraulic motors which are operable by high pressure ocean water from the conduit section 32. For purposes of clarity of presentation, such lines have been omitted from FIG. 2, however, it will be understood that this is a preferred arrangement.

With the above in mind it can be seen that high pressure pump 22 on the surface vessel 12 must have an energy input sufficient to drive the aforesaid instrumentalities and to, in addition, overcome the friction loss due to the flow in conduits 32 and 34 as well as to provide the energy required to lift the nodules from the exchange position within the vicinity of the ocean floor where the nodules to be recovered are deposited upwardly to the discharge position on the surface of the surface vessel. These energy requirements are importantly determined by the depth at which recovery is to be made but a range of 1,000 to 10,000 horsepower input to the pump 22 would be required for most installations.

When the apparatus 10 is utilized to practice the method of the present invention the operation is generally as follows. After the apparatus has been suitably deployed, movement of the harvester assembly 18 along the ocean bottom will cause nodule particles and contiguous small particles to pass under large nodule deflector plates 58 and onto the surface of the first screen 48 where the material is moved upwardly and rearwardly therealong by scraper conveyor 52. As the material moves over the first screen 48 the flow of ocean water in the second path from conduit 44 and outlet hood 46 moves over and through the first screen so as to carry with it the small particles such as silt and other bottom sediment, leaving the separated nodules to be moved by the scraper conveyor 52 upwardly and rearwardly from the first screen 48 onto the second screen 50. Inlet hood 56 below the second screen therefore constitutes a feed position within the second flow path whereby flow of ocean water is induced through the second screen so as to draw the nodules being moved by the scraper conveyor 42 therethrough. Oversize nodules and any other particles larger than nominal diameter size are simply dumped over the second screen by the movement of the scraper conveyor 42.

The nodules fed into the second flow path in the feed position provided by the inlet hood 56 move with the entraining ocean water flow through the conduit 54 to the exchange position in the second flow path provided by the transfer device 38. As previously indicated, a fixed screen in the housing surrounding the rotor at the position thereof wherein conduit 42 is connected therewith prevents the flow of the nodules with the ocean water through the pockets of the rotor so that they are retained with appropriate entraining water in the pockets and transferred at the exchange position of the first flow path into the first flow path.

As previously indicated, flow of ocean water in the first path is established at an energy level sufficient to provide energy for not only moving the rotor of the transfer device, the scraper conveyor 42 and the pump 40 but also to accomplish the conveyance of the nodules transferred into the first flow path by the transfer device at the exchange position therein. It will be understood that the flow of ocean water in conduit sections 32 and 34 at the exchange position provided by transfer device 38 is of an energy level considerably in excess of the energy level of the liquid flowing through the exchange position in the second path. It will be noted that the exchange of successive incremental volumes of nodules and ocean water from the second path to the first path with comparable volumes of ocean water from the first path to the second path results in a net flow of water from the first path to the second path which is generally equal to the volume of the nodules inserted into the first path. Accordingly, the capability of pump 40 is chosen so that it will accommodate this net change in the water flow while still maintaining sufficient flow within conduit 54 to insure conveyance of the separated nodules from the second stream therethrough. It will be understood that if necessary, an inlet hood may be provided over the second screen 50 so as to provide a remote source of ocean water for passage through the second screen 50 into the inlet 56. Such a remote source may be desirable due to the discharge of small particles through the adjacent first screen.

Figure 3:
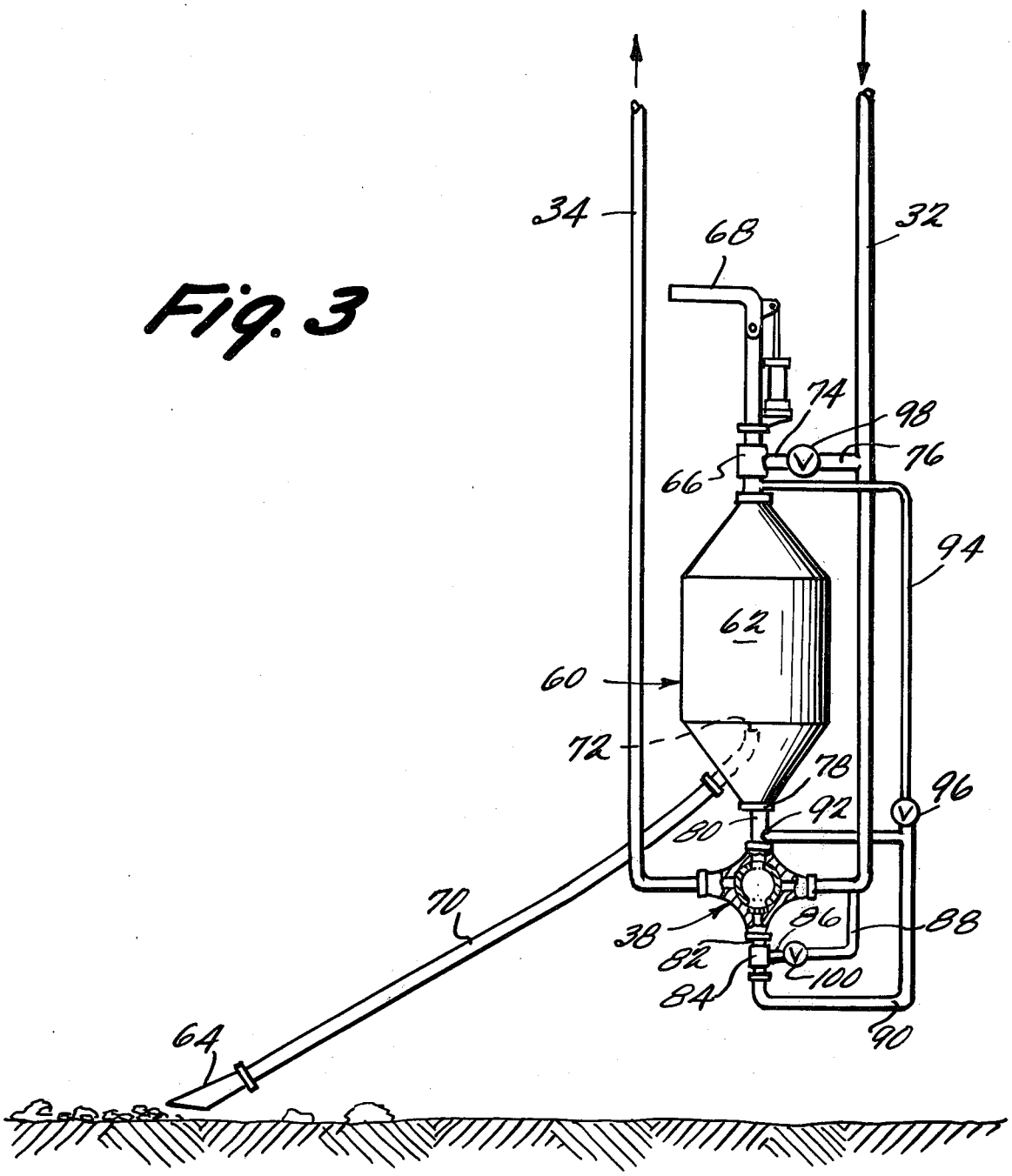
FIG. 3 is a generally schematic view illustrating another embodiment of the apparatus components operating in the ocean floor vicinity.

In FIG. 3 there is shown a preferred modification of the present invention in which the harvesting and nodule separating functions of the harvesting device 18 are accomplished by an alternative harvesting device, generally indicated at 60. The device 60 consists essentially of a water and particle containing chamber or vacuum vessel 62 having an inlet 64 provided for the flow of ocean water containing mineral nodules below a predetermined size and other smaller particles therethrough into the chamber. Mounted in a first position at the upper end of the vessel 62 is a pump 66 having its inlet communicated with the interior of the chamber so as to pump water and entrained small particles within the chamber outwardly of the chamber into the ocean. As shown, a movable discharge jet pipe 68 is connected with the outlet of the pump 66. It will be understood that suitable controls may be provided for effecting movement of the discharge jet so that the outward flow of liquid from the jet into the surrounding ocean can be utilized to provide a moving force for the vessel 62 and its inlet 64.

It will be noted that the inlet 64 is communicated with the interior of the vessel 62 by a conduit 70 which extends from the inlet to a second position indicated at 72 within the interior of the vessel 62 spaced below the first position thereof where pump 66 is mounted. Pump 66 is driven by a suitable hydraulic motor 74 which receives pressurized ocean water from a line 76 communicating with conveyor conduit section 32. The flow of ocean water, nodules and fine particulate material from the ocean floor induced into the inlet 64 through conduit 70 and into the vessel 62 at position 72 by the operation of the pump 66 is such that as the nodules enter the relatively large interior of the vessel their movement is soon dominated by their gravitational weight so that the nodules once they have entered the second position 72 within the chamber tend to settle out or move downwardly under the action of gravity within the ocean water contained within the vessel 62. At the same time, there is sufficient flow of liquid toward the upper first position leading to the pump 66 that the smaller particles entering the vessel 62 at position 72 are entrained by the water flow and tend to move upwardly and outwardly with the discharging ocean water.

At a third position indicated at 78 in the bottom of the vessel 62 toward which the nodules tend to move there is connected a conduit section 80 which defines a part of a second confined circuitous path within the ocean vicinity where the nodules to be recovered are deposited on the ocean floor. As shown in FIG. 3, conduit 80 is connected to transfer device 38 in lieu of the connection 54 therewith previously recited. The connection of the transfer device 38 previously connected with conduit 42 is connected with a conduit 82 which leads to a pump 84 similar to pump 40 previously described. As shown, pump 84 is driven by a hydraulic motor 86 receiving its hydraulic energy from a line 88 connected with main conduit 32 of the first flow path. The outlet of pump 84 is connected to one end of a conduit 90, the opposite end of which is connected with the conduit 80 as indicated at 92. A bleed control line 94 is provided for the conduit 90 which extends therefrom to the inlet of the pump 66. Bleed line 94, as well as hydraulic motors 74 and 84, are provided with suitable controls that may be operated from the surface vessel, such controls being schematically illustrated at 96, 98 and 100 respectively in FIG. 3.

Where the modifications shown in FIG. 3 are utilized to practice the method of the present invention the operation is as follows.

Flow inlet or dredge head 64 contains screen bars to prevent sucking up of particles larger than a predetermined size (e.g. eight inches nominal diameter), is dragged across the ocean bottom. During this movement pump 66 establishes a continuous flow in the second flow path which sucks up silt and nodules through the inlet 64. Flexible conduit 70 is rigidly fastened to an inlet pipe fixed on gravity settling vessel 62 which discharges at 72 near the lower end of the vessel vertically upwardly near the axis of the vessel. The flow of sea water, silt, and nodules in conduit 70 is at a high enough velocity to keep all of the solids moving to settling vessel 62. Gravity settling vessel 62 is cylindrical with conical heads at each end. The cylindrical cross-section of vessel 62 is large compared to the cross-section of conduit 70.

The flow in conduit 70 will be greater than Durand's deposit velocity for solids flow in pipes. This deposit velocity is predetermined and is dependent upon the solids specific gravity and the conduit 70 internal diameter. When the solids and sea water discharge at 72, the velocity drops due to the large cross-section of the gravity settling vessel 62.

The cross-section of vessel 62 is sized to produce an upward velocity greater than the settling velocity of the silt but less than the settling velocity of the nodules. This classifying of the particles is easily accomplished since the silt particles are considerably smaller than the nodules. The most important mining area for nodules is in the North Pacific Ocean. Average silt particle sizes range from 0.86 to 1.73 microns. Nodules are found here at depths ranging from 3,206 to 5,997 meters. Collectible nodule sizes are expected to range in sizes from ¼ inch to 8 inches. Referring to Perry's Chemical Engineering Handbook, Fifth Edition, page 5-65, FIGS. 5-82, it can be seen that particle sizes less than 10 microns, for all specific gravities, will rise in the vessel 62 when the upward velocity is greater than 0.002 feet per second. Referring again to the same figure, particles greater in size than ¼ inch, for all specific gravities, will settle when the upward velocity is less than 0.1 feet per second. Therefore, the settling vessel cross section diameter is sized within this velocity range to allow silt to rise and nodules to settle.

The water motor driven centrifugal pump 66 is mounted on the upper end of vessel 62 to produce suction and classifying flow. More than one such pump can be utilized. The preferred pump 66 is an integral turbine impellor type described in "Pump Applications Engineering", Hicks, H. G. and Edwards, T. W., 1971, pages 227-228. With such a pum and turbine drive, high pressure water at low flows produces low pressure water at high flows. Such pumps and drives operate at better than 50% efficiency. Silt particles passing through such pumps offer no difficulties. The high pressure water needed to drive this pump is produced by the multistage centrifugal pump 22 located on the surface vessel 12.

Nodules that settle to the bottom of vessel 62 migrate by gravity into chute 80 and then into transfer device 38. The transfer device is driven by a hydraulic motor or water turbine and transfers nodules into the first flow path, as aforesaid. During the transfer of solid particles from the second flow path to the first flow path, a transfer of water is made from the first high pressure flow path to the second flow path equal to the volume of the solids transferred, said water transfer being entitled displacement. A leakage of water exists from the high pressure flow path to the low pressure flow path due to the tolerance between the transfer device rotor and housing. If the leakage and displacement is high the upward velocity in chute 80 will prevent satisfactory settling of nodules into the transfer device 38. An additional difficulty is that the time available for settling of nodules into the transfer device, rotor holes is small and therefore the nodules will not efficiently fill into the transfer device. This difficulty is overcome by imposing a rapid draw down of water into the transfer device 38. The rapid draw down is accomplished by the second water turbine driven pump 84. The pump 84 draws water through screens located in the bottom port of the transfer device. The screens stop the nodules and allow the water to pass through. The water discharged from pump 84 is directed back to chute 80 via conduit 90 creating a closed circulatory loop to cause rapid filling of nodules into transfer device 38. Since this loop is closed displacement and leakage will still flow upward into settling vessel 62. A vent line 94 located on the circulatory loop vents a controlled portion of the displacement and leakage to the sea via pump 66 inlet. The vent rate will be slightly less than the displacement and leakage which will still provide a small upward sweep of clean surface water into settling vessel 62.

Figure 4:
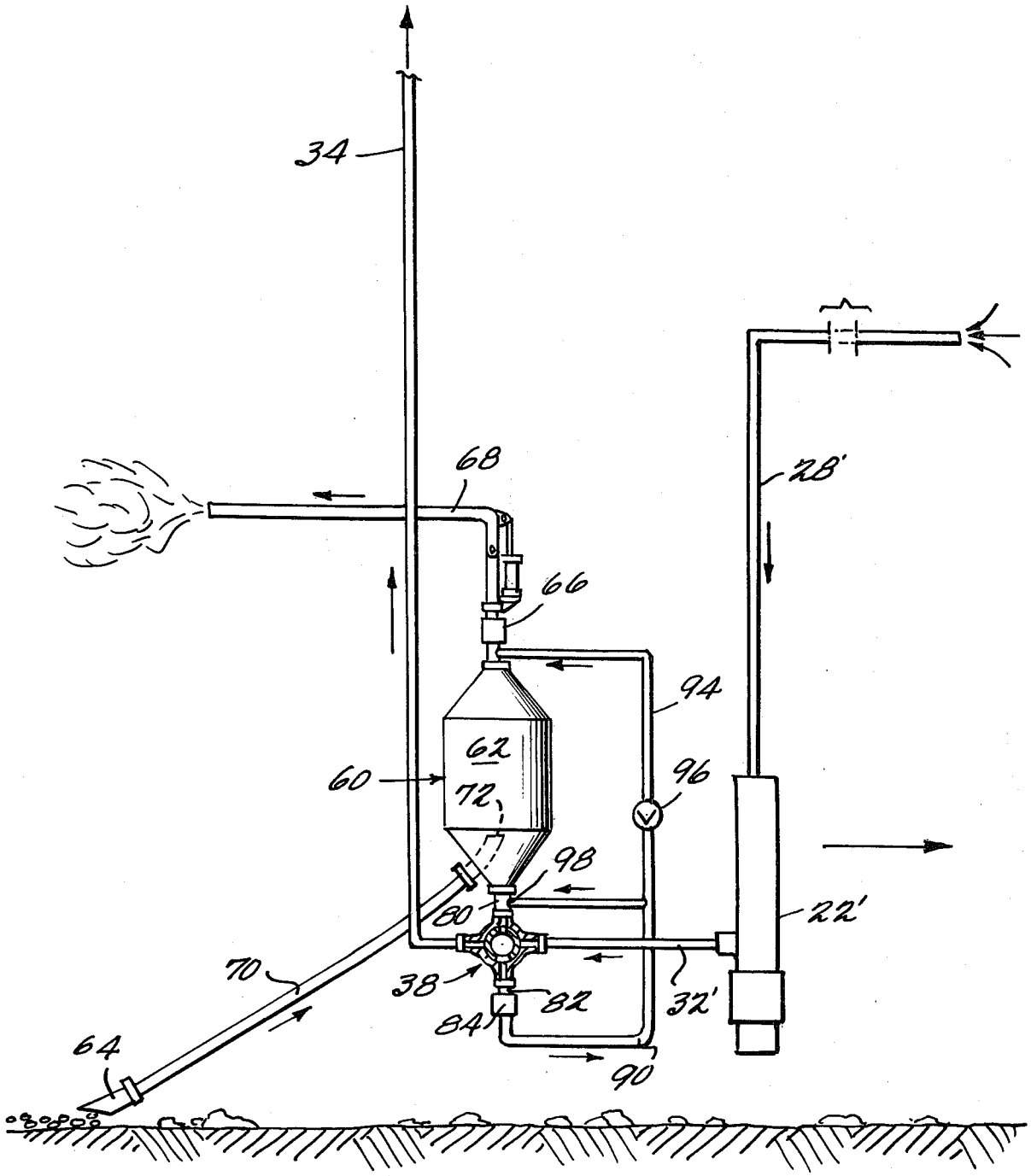
FIG. 4 is a generally schematic view similar to FIG. 3 illustrating another embodiment of the apparatus components operating in the ocean floor vicinity.

Referring now more particularly to FIG. 4, there is shown therein certain modifications of the apparatus thusfar described which is within the contemplation of the present invention. FIG. 4 is similar to FIG. 3 and correspondingly similar parts have been designated by the same reference numeral whereas the modified or rearranged parts are designated by primed numerals corresponding to the numerals of the previously described parts which have been modified or rearranged. Basically, the modification of FIG. 4 relates to the shortening of the conduit section 32 almost to the point of elimination and the relocation of the conveying pump 22 and its inlet line 28 in the ocean. In the embodiments previously described, the feature of mounting the main conveying pump 22 on the surface vessel 12 has the advantage that the 1000 to 10,000 horsepower motor utilized as the energy input of the pump could be mounted and energized from an essentially atmospheric environment. However, in order to achieve this advantage it becomes necessary to provide a conduit section 32 which has a length generally equal to the depth of operation. The modification of FIG. 4 recognizes that it may be desirable to reverse this advantage-disadvantage situation by substantially eliminating the long conduit section 32 and its attendant disadvantages while taking on the disadvantage of operating pump 22 under ocean bottom pressure conditions and the attendant disadvantage of extending energizing conduits from the surface thereto.

As shown in FIG. 4, pump 22' is located adjacent transfer device 38 and settling vessel 62. Only a relatively short outlet conduit section 32' extends from the pump 22' to the transfer device 28. The inlet of the line 28' for the pump 22 is positioned sufficiently remote from the position of nodule pick-up at 64 and small particle discharge at 68 to draw therein ocean water substantially free of the small particles including nutrients that are displaced by virtue of the nodule pick-up at 64 and small particle discharge at 68. It will be understood that the modifications of FIG. 4 are equally applicable to the arrangement shown in FIGS. 1-2.

Figure 5:
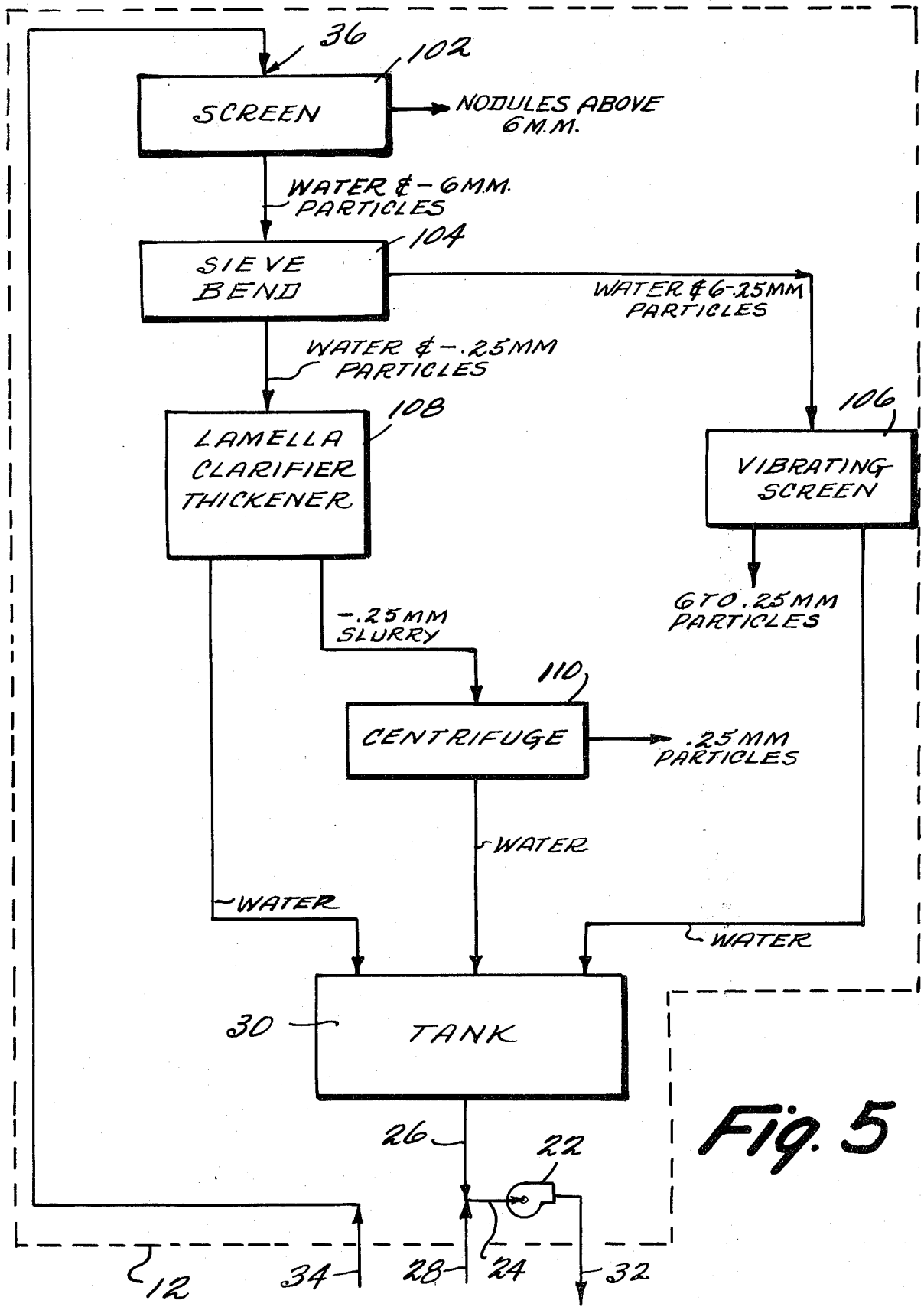
FIG. 5 is a schematic view illustrating the separating procedures and apparatus components in the surface vessel utilized in accordance with the principles of the present invention.

Referring now more particularly to FIG. 5, there is shown therein a combination of apparatus components which are arranged to be mounted on a surface vessel at the discharge position of the first flow path so as to receive the flow of ocean water and separated nodules issuing at the discharge position of the first flow path. The apparatus components basically function to separate the nodule material from the water and to direct the clarified water into the tank 30 so that it may as in the embodiments of FIGS. 1-3 provide a source of ocean water to be drawn into the flow of the first path by the main pump 22. As schematically illustrated in FIG. 5, the separating apparatus includes a first screen 102 on which the discharge of the flow from conduit 34 of the first flow path is directed. The screen is of a conventional nature and serves to separate out nodules of a particle size above 6 mm permitting water and particles below 6 mm to leave in the underflow fraction thereof. The underflow fraction is then fed to a sieve bend 104 which serves to separate the underflow fraction into an overflow fraction containing water and particles greater than 0.25 mm and an underflow fraction which consists of water and particles below 0.25 mm. The overflow fraction from the sieve bend 104 is fed to a vibrating screen 102 for the purpose of separating the water therefrom. Accordingly, the discharge from the vibrating screen will consist essentially of particles of nodule material within a size range of from 6 mm to 0.25 mm while the underflow thereof consists essentially of water which is directed to the tank 30.

The underflow fraction from the sieve bend consisting of water and fine particles less than 0.25 mm is fed to a Lamella clarifier-thickener 108 which operates to obtain a clarified water fraction which is fed directly to the tank 30 and a slurry of fine particles less than 0.25 mm. The fine slurry fraction is fed to a centrifuge 110 which serves to separate the water therefrom which water is fed to the tank 30. Centrifuge 110 thus provides a source of relatively dry fine particles in a size range below 0.25 mm. It will be understood that the separation sizes indicated above are illustrative only as is the particular utilization of apparatus components 102, 104, 106, 108 and 110, and that other separating arrangements for recovering clarified water and nodule material may be utilized. It will be noted, however, that by utilizing this separation procedure in conjunction with the basic recovery procedures of the present invention, the normal operation of the method does not result in the dumping of any substantial amount of material or water moved upwardly from the ocean bottom to a position near the surface thereof.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A method of recovering mineral nodules of a size range up to 8" nominal diameter deposited on the ocean floor which comprises the steps of pumping a continuous flow of ocean water along a first confined path extending through an exchange position within the vicinity of the ocean floor where the mineral nodules to be recovered are deposited from an ocean water inlet position out of said ocean vicinity and then upwardly to a discharge position on a surface vessel, confining ocean water within a second path within the aforesaid ocean vicinity, continuously flowing ocean water in said second path by pumping the same at a pumping position spaced downstream from an exchange position therein, continuously moving from the ocean floor to a separating position within said ocean vicinity a mixture containing deposited mineral nodules of up to 8" nominal diameter and smaller particles forming a part of the ocean floor on which the mineral nodules were deposited, continuously separating at said separating position said mixture so as to obtain a supply of separated mineral nodules up to 8" nominal diameter within ocean water separate from the remainder of said mixture which contains said smaller particles, returning said smaller particles in the remainder of said mixture to the ocean at a position within said ocean vicinity, continuously feeding the supply of separated mineral nodules to said second path at a feeding position upstream from the exchange position therein, and continuously exchanging between the exchange positions within said first and second paths successive incremental volumes of ocean water and mineral nodules from said second path to said first path with comparable successive incremental volumes of ocean water from said first path to said second path whereby the mineral nodules within said second path are removed therefrom upstream of the pumping position in said second path and moved into said first path downstream from the pumping position in said first path for movement in said first path to said discharge position.

2. A method as defined in claim 1 wherein said separation at said separation position is achieved by continuously mechanically moving the nodules and smaller particles from the ocean floor over a first screen of a predetermined small size sufficient to prevent passage of nodules therethrough, directing the flow of ocean water in said second path upstream from the pumping position over and through said first screen to move the smaller particles through said first screen, continuously mechanically moving the nodules from said first screen onto a second screen of a predetermined large size sufficient to permit the passage of nodules therethrough, the feeding position of said second path being below said second screen whereby the supply of separated mineral nodules fed to said second path constitutes mineral nodules passing through said second screen.

3. A method as defined in claim 1 wherein said separating position is within a liquid and particle containing chamber having an inlet communicating therewith for a flow of ocean water containing mineral nodules below a predetermined size and other smaller particles therethrough into said chamber, continuously pumping ocean water and entrained smaller particles from a first position within said chamber into the ocean at a rate sufficient to maintain a flow of ocean water, mineral nodules below said predetermined size and smaller particles through said inlet and into said chamber at a second position spaced from said first position, continuously moving the mineral nodules entering said chamber at said second position into a third position within said chamber spaced from said first and second positions, said second path being a circuitous path communicating at the feeding position thereof with said chamber at said third position thereof.

4. A method as defined in claim 1, 2 or 3, wherein the water and nodules in said first path at said discharge position are subject to separation treatment producing clarified ocean water.

5. A method as defined in claim 4 wherein the ocean water pumped along said first path is pumped at a position on said surface vessel drawn at least in part from said clarified ocean water and from the ocean at an ocean water inlet position below and near the ocean surface.

6. A method as defined in claim 4 wherein said separation treatment includes screening the water and nodules so as to obtain nodules above a first predetermined size and a fraction of water and small particles below said predetermined size, feeding the fraction of water and small particles to sieve bend means to obtain an overflow fraction of water and small particles between said first predetermined size and a smaller second predetermined size and an underflow fraction of water and fine particles below said second predetermined size, feeding the overflow fraction to vibrating screen means to obtain particles between said first and second predetermined sizes and clarified ocean water, feeding the undersize fraction to clarifier-thickener means to obtain clarified ocean water and a slurry of fine particles, feeding the slurry of fine particles to centrifuge means to obtain fine particles and clarified ocean water.

7. A method as defined in claim 1 or 3 wherein the ocean water pumped along said first path is pumped at a position within said ocean vicinity and said ocean water inlet position is out of said ocean vicinity just sufficient to prevent the appreciable intake of displaced smaller particles.

8. A method of recovering mineral nodules of a size range up to 8" nominal diameter deposited on the ocean floor which comprises the steps of providing within the ocean a liquid and particle containing chamber having an inlet communicating therewith for a flow of ocean water containing mineral nodules below a size approximately 8" nominal diameter and other smaller particles therethrough into said chamber, continuously pumping ocean water and entrained smaller particles from a first position within said chamber into the ocean at a rate sufficient to maintain a flow of ocean water, mineral nodules below said size and smaller particles through said inlet and into said chamber at a second position spaced from said first position, continuously moving the mineral nodules entering said chamber at said second position into a third position within said chamber spaced from said first and second positions, pumping a continuous flow of ocean water along a first confined path extending through an exchange position adjacent the chamber and then upwardly to a discharge position on a surface vessel, confining ocean water within a second circuitous path communicating with said chamber at said third position thereof, continuously circulating ocean water in said second path by pumping the same at a pumping position spaced downstream from the position of communication thereof with said chamber passed an intermediate exchange position whereby mineral nodules at said third position within said chamber move therefrom into said exchange position within said second path, and continuously exchanging between the exchange positions within said first and second paths (1) successive incremental volumes of ocean water and mineral nodules from said second path to said first path and (2) comparable successive incremental volumes of ocean water from said first path to said second path whereby the mineral nodules within said second path are removed therefrom upstream of the pumping position in said second path and moved into said first path downstream from the pumping position in said first path for movement in said first path to said discharge position.

9. A method as defined in claim 8 wherein said nodules move from said second position within said chamber into said third position therein downwardly by gravity and the smaller particles move from said second position into said first position by entrainment within ocean water flow therebetween.

10. A method as defined in claim 8 or 9 wherein the ocean water continuously flowing along said first confined path is pumped at a position on said surface vessel.

11. A method as defined in claim 8 or 9 wherein the ocean water continuously flowing along said first confined path is pumped at a position adjacent said chamber.

12. Apparatus for recovering mineral nodules of a size range up to 8" nominal diameter deposited on the ocean floor comprising first conduit means defining a first confined path extending through an exchange position within the vicinity of the ocean floor where the mineral nodules to be recovered are deposited from an ocean water inlet position out of said ocean vicinity and then upwardly to a discharge position on a surface vessel, first pump means for continuously flowing ocean water into and through said first path, second conduit means defining a second path for ocean water within the aforesaid ocean vicinity, second pump means for continuously flowing ocean water in said second path by pumping the same at a pumping position spaced downstream from an exchange position therein, means for continuously moving from the ocean floor to a separating position within said ocean vicinity a mixture containing deposited mineral nodules of up to 8" nominal diameter and smaller particles forming a part of the ocean floor on which the mineral nodules were deposited, means for continuously separating at said separating position said mixture so as to obtain a supply of separated mineral nodules of up to 8" nominal diameter within ocean water separate from the remainder of said mixture which contains said smaller particles and for returning said smaller particles in the remainder of said mixture to the ocean at a position within said ocean vicinity, means for continuously feeding the supply of separated mineral nodules to said second path at a feeding position upstream from the exchange position therein, and means for continuously exchanging between the exchange positions within said first and second paths successive incremental volumes of ocean water and mineral nodules from said second path to said first path with comparable successive incremental volumes of ocean water from said first path to said second path whereby the mineral nodules within said second path are removed therefrom upstream of said second pump means in said second path and moved into said first path downstream from said first pump means in said first path for movement in said first path to said discharge position.

13. Apparatus as defined in claim 12 wherein said separating means includes a first screen of a predetermined small size sufficient to prevent passage of nodules therethrough, means for directing the outlet flow of ocean water in said second path upstream from the pumping position over and through said first screen, a second screen of a predetermined large size sufficient to permit the passage of nodules therethrough, means for communicating the inlet flow of said second path below said second screen so as to constitute the feeding position of said second path, and means for continuously mechanically moving the nodules and smaller particles from the ocean floor over said first screen and said nodules over said second screen whereby the outlet flow of said second path will move the smaller particles through said first screen and the inlet flow of said second path will draw nodules through said second screen into the feeding position of said second path.

14. Apparatus as defined in claim 12 wherein said separating means includes a liquid and particle containing chamber having an inlet communicating therewith for a flow of ocean water containing mineral nodules below a predetermined size and other smaller particles therethrough into said chamber, means for continuously pumping ocean water and entrained smaller particles from a first position within said chamber into the ocean at a rate sufficient to maintain a flow of ocean water, mineral nodules below said predetermined size and smaller particles through said inlet and into said chamber at a second position spaced from said first position so that the mineral nodules entering said chamber at said second position move into a third position within said chamber spaced from said first and second positions, said second path being a circuitous path communicating at the feeding position thereof with said chamber at said third position thereof.

15. Apparatus as defined in claim 12, 13 or 14 including means for subjecting the water and nodules in said first path at said discharge position to separation treatments producing clarified ocean water.

16. Apparatus as defined in claim 15 wherein said means for subjecting said nodules and ocean water to separation treatment includes screening means for the water and nodules operable to obtain nodules above a first predetermined size and a fraction of water and small particles below said predetermined size, sieve bend means, means for feeding the fraction of water and small particles to said sieve bend means to obtain an overflow fraction of water and small particles between said first predetermined size and a smaller second predetermined size and an underflow fraction of water and fine particles below said second predetermined size, vibrating screen means, means for feeding the overflow fraction to said vibrating screen means to obtain particles between said first and second predetermined sizes and clarified ocean water, clarifier-thickener means, means for feeding the undersize fraction to said clarifier-thickener means to obtain clarified ocean water and a slurry of fine particles, centrifuge means, and means for feeding the slurry of fine particles to said centrifuge means to obtain fine particles and clarified ocean water.

17. Apparatus as defined in claim 15 wherein said first pump means is operable from a position on said surface vessel, means for communicating the clarified ocean water to the inlet of said first pump means, said first conduit means including two coextensive sections, one extending from said first pump means to said ocean vicinity and the other extending from said ocean vicinity to said surface vessel.

18. Apparatus as defined in claim 15 wherein said first pump means is operable from a position within said ocean vicinity, said inlet ocean water inlet position being out of said ocean vicinity just sufficient to prevent pick-up of displaced smaller particles.

19. Apparatus for recovering mineral nodules deposited on the ocean floor comprising;

means defining a liquid and particle containing chamber having an inlet communicating therewith for a flow of ocean water containing mineral nodules below a predetermined size and other smaller particles therethrough into said chamber, means for continuously pumping ocean water and entrained smaller particles from a first position within said chamber into the ocean at a rate sufficient to maintain a flow of ocean water, mineral nodules below said predetermined size and smaller particles through said inlet and into said chamber at a second position spaced from said first position so that the mineral nodules entering said chamber at said second position will move into a third position within said chamber spaced from said first and second positions, first conduit means defining a first confined path extending through an exchange position adjacent the chamber and then upwardly to a discharge position on a surface vessel, first pump means for pumping a continuous flow of ocean water into and along said first path, second conduit means defining a second path in the form of a circulatory loop communicating with said chamber at said third position thereof, second pump means for continuously circulating ocean water in said second path by pumping the same at a pumping position spaced downstream from the position of communication thereof with said chamber passed an intermediate exchange position whereby mineral nodules at said third position within said chamber move therefrom into said exchange position within said second path, and means for continuously exchanging between the exchange positions within said first and second paths (1) successive incremental volumes of ocean water and mineral nodules from said second path to said first path and (2) comparable successive incremental volumes of ocean water from said first path to said second path whereby the mineral nodules within said second path are removed therefrom upstream of the pumping position in said second path and moved into said first path downstream from the pumping position in said first path to said discharge position.

* * * * *